United States Patent [19]

Fenton et al.

[11] 3,974,865

[45] Aug. 17, 1976

[54] VAPOR COLLECTING NOZZLE

[75] Inventors: David T. Fenton, Madison; Allen M. Bower, Painesville, both of Ohio

[73] Assignee: Emco Wheaton Inc., Conneaut, Ohio

[22] Filed: Jan. 21, 1975

[21] Appl. No.: 542,857

[52] U.S. Cl. ..... 141/311 R; 141/226; 141/392

[51] Int. Cl.[2] ..... B65B 3/18; B67C 3/34

[58] Field of Search ..... 141/52, 59, 93, 128, 141/198, 206–229, 290, 392, 311

[56] References Cited

UNITED STATES PATENTS

| | | | |
|---|---|---|---|
| 3,710,831 | 1/1973 | Riegal | 141/207 |
| 3,719,215 | 8/1973 | Murray | 141/207 |
| 3,780,776 | 12/1973 | Eklund | 141/207 |
| 3,835,899 | 9/1974 | Holder | 141/226 X |

*Primary Examiner*—Richard E. Aegerter
*Assistant Examiner*—Frederick R. Schmidt
*Attorney, Agent, or Firm*—Fetherstonhaugh & Co.

[57] ABSTRACT

An automatic shut-off nozzle incorporating a vapor recovery system for recovering the displaced vapors from a gasoline storage tank or the like as the tank is being filled by the nozzle wherein the nozzle is automatically shut-off when the pressure within the vapor recovery system increases above a predetermined minimum pressure. The nozzle incorporates a latching mechanism which is releasable in response to the increase in pressure in the vapor recovery system and which is also responsive to a loss of vacuum pressure resulting from the level of the liquid in the storage tank rising above a predetermined level with respect to the nozzle. The nozzle is constructed such that the ambient pressure in the main diaphragm chamber corresponds to the pressure of the vapor recovery line so that the release mechanism for the slide is not as sensitive to the pressure in the gasoline storage tank. The nozzle also includes an improved vapor recovery shroud which incorporates a fulcrum support carried by the body of the nozzle which serves to direct the end sealing ring of the shroud into engagement with the end of the filling tube of a gasoline storage tank or the like.

2 Claims, 14 Drawing Figures

Figure 2:
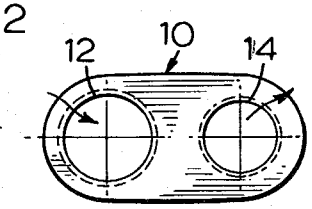

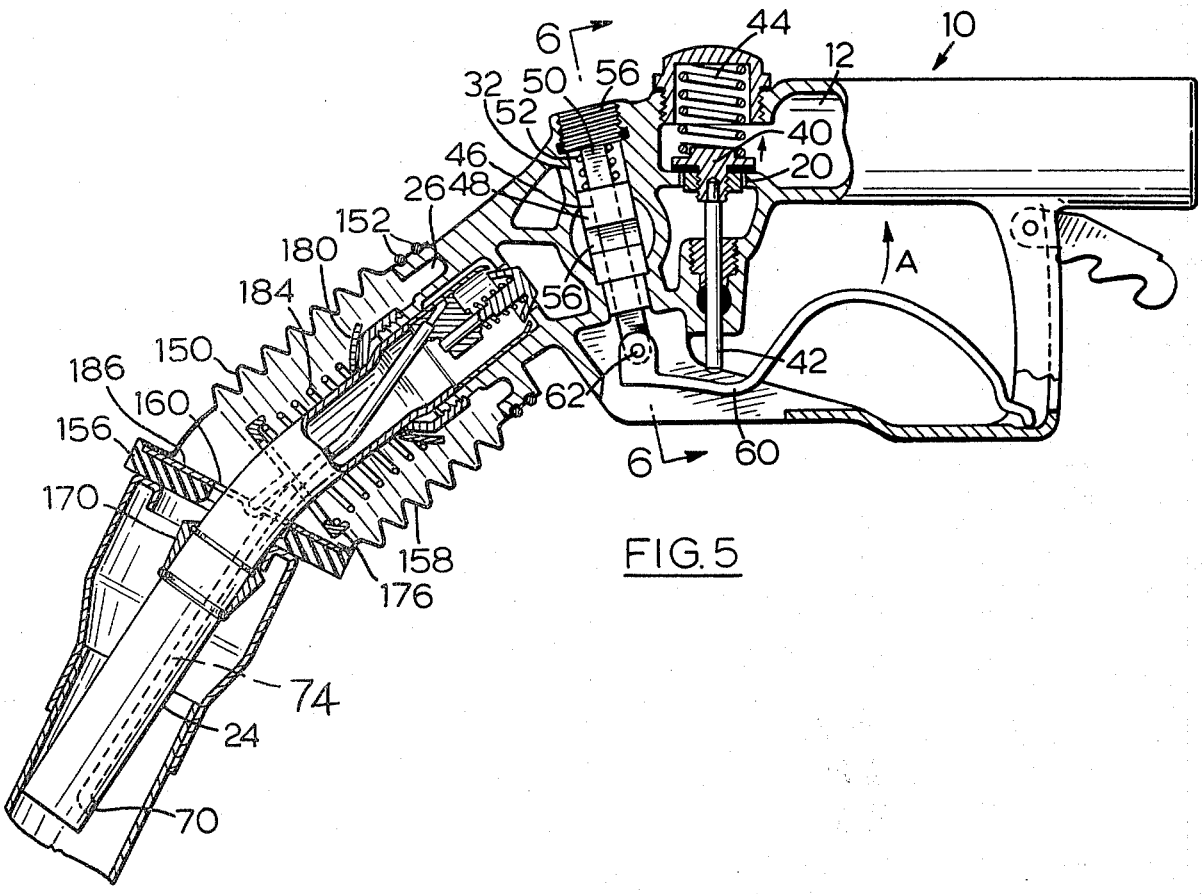
FIG. 5
FIG. 6
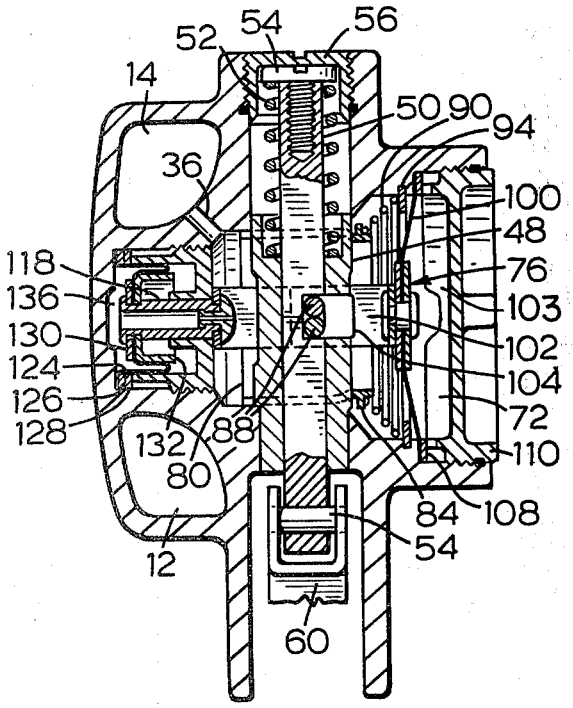

FIG. 11
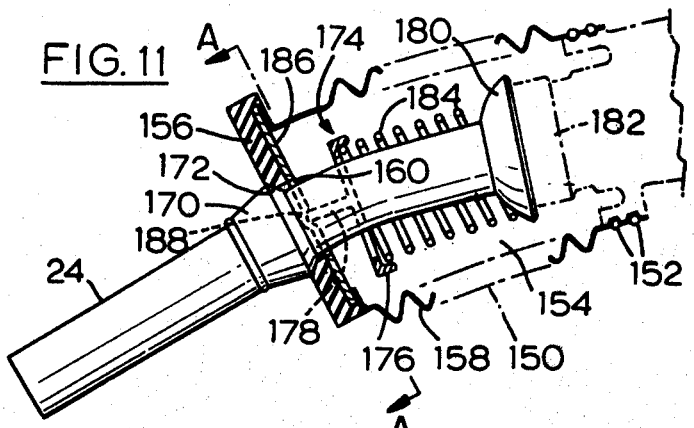
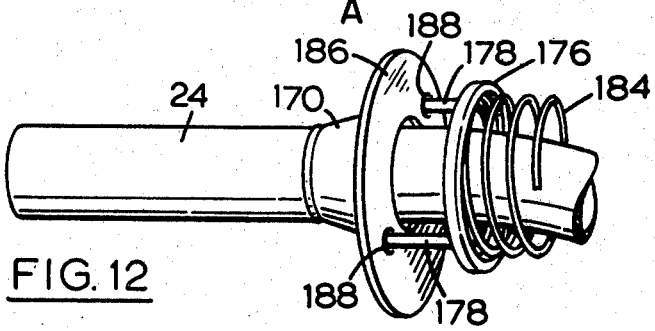
FIG. 12
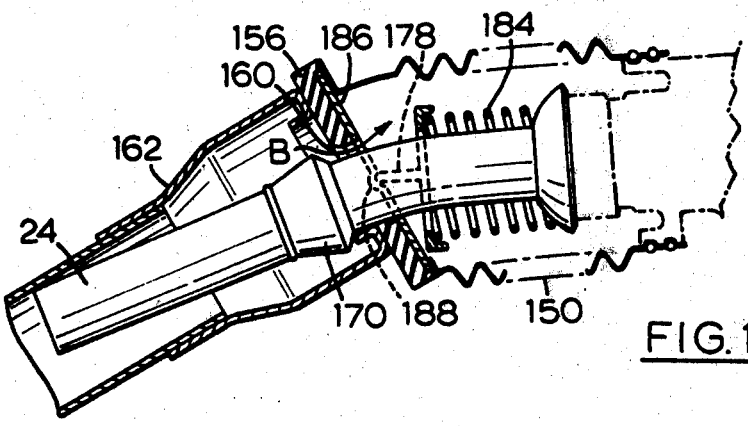
FIG. 13
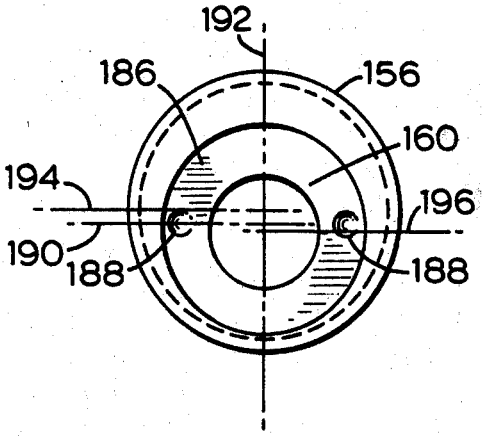
FIG. 14

VAPOR COLLECTING NOZZLE

FIELD OF INVENTION

This invention relates to automatic nozzles. In particular, this invention relates to automatic nozzles for use in filling automobile gasoline tanks in which the vapour displaced during the filling operation is to be recovered.

PRIOR ART

In order to reduce atmospheric pollution and to conserve energy, it has been proposed that the vapour which is displaced from an automobile gasoline tank during filling at a filling station should be recovered. Previous proposals have indicated that the displaced vapour may be recovered through passages formed in the body of the nozzle. Difficulties have, however, been encountered as a result of the pressure build-up in the vapour recovery system which may be caused by an obstruction in the vapour recovery line or the like. If there is obstruction in the vapour recovery line and the operator continues to pump fuel into the automobile storage tank, the pressure in the vapour recovery line will build up and may climb to a dangerously high level. Most gasoline storage tanks of automobiles are not designed to accommodate high pressures and may rupture if subjected to high pressures.

In order to prevent pressure build-up in vapour recovery systems which have previously been developed, it has been proposed to incorporate the pressure relief valve in the vapour recovery line, the valve being designed to vent to atmosphere in the event of a pressure build-up in the vapour recovery line. It follows that in this system if the pressure does become unduly high in the vapour line, the pressure relief valve will blow and the vapour recovery line will vent to atmosphere thereby causing atmospheric pollution and fuel waste which the vapour recovery system is specifically designed to prevent.

An automatic fuel dispenser nozzle which incorporates a mechanism which is adapted to interrupt the flow of gasoline into a storage tank when the pressure builds up in the storage tank is described in U.S. Pat. No. 3,771,575 dated Nov. 13, 1973 issued to Texaco Inc. In this device two diaphragm chambers are provided, one of which is the conventional chamber which activates a latch mechanism which releases the plunger on which the handle is pivotally mounted when the level of liquid in the tank which is being filled rises above a predetermined level and interrupts the venting of the vacuum chamber. The other diaphragm chamber designed to operated the same latching mechanism through the same latching pin in response to a pressure increase in the storage tank. In this construction both diaphragms must move in order to permit movement of the latching mechanism. Furthermore, the operation of both diaphragms requires the compression of a coil spring which is required in order to seat the latching mechanism. As previously indicated the positive pressure to which a gasoline tank of an automobile may be submitted is very low, of the order to about one P.S.I., so that the forces which are available to move the pressure diaphragm are limited. For this reason the apparatus of the present invention provides two separate latching mechanisms which are operable independently of one another whereby the latching mechanism, which is operative in response to the positive pressure, may be sufficiently sensitive to operate at low pressures, while the diaphragm, which is operative in response to variations in pressure in the vacuum generated during the filling operation, may be operated by the application of a pressure which is different to that applied to operate the positive pressure diaphragm.

In the conventional automatic nozzle, the ambient pressure on the side of the diaphragm opposite to the side to which the venturi suction is applied is atmospheric pressure. The vacuum vent passage is located within the open neck of the storage tank and during the filling operation will also be operating at about atmospheric pressure. If, however, the end of the neck of the storage tank is closed, as in the case when a vapour recovery system is in use, the pressure at the sensing device will be that of the pressure in the vapour recovery line. This pressure may vary substantially from one installation to another and difficulty may be experienced in obtaining the required automatic cut-off as a result of the varying pressure differential between opposite sides of the latch actuator diaphragm. This difficulty is overcome in the present invention by reason of the fact that the ambient pressure at the diaphragm is that of the pressure in the vapour recovery line.

In the structure of nozzles previously designed for use in association with the recovery of vapour difficulty has been experienced in providing an effective structure for preventing the escape of the vapour which is trapped in the line leading from the nozzle to the vapour recovery storage tank after the nozzle is removed from the automobile gas tank. As a result there is a tendency for the recovered vapours to escape from the vapour recovery line through the input passages at the nozzle end of the line when the nozzle is not in use. Difficulty has also been experienced in attempting to provide an effective seal between the shroud and the end of the filling opening of the gasoline storage tank.

SUMMARY

The present invention overcomes the difficulties of the prior art described above and provides a simple and efficient vapour recovery system and incorporates it into an automatic nozzle which serves to prevent dangerous build-up of pressure in the vapour recovery line, prevents escape of vapour from the vapour recovery line after the nozzle is removed from the automobile gasoline tank and which provides an effective shroud for guiding the displaced vapour from the filling neck of the gasoline storage tank to the vapour recovery input passages and the nozzle.

According to an embodiment of the present invention it is provided in an automatic nozzle of the type having a body, a liquid flow passage extending through the body, a main valve in the liquid flow passage, valve actuator means movable between the closing of the liquid flow passage and the position opening the liquid flow passage, latch means moveable between a first position serving to permit the main valve actuator means to move to said position opening said valve and the second position in which the valve actuator means is not capable of opening the valve, first latch actuator means operable in response to the level of liquid in a tank being filled rising above a predetermined level to move said latch means to said second position, the improvement wherein said latch means is movable to said first position to said second position independently of said first latch actuator means, said body being formed to provide a vapour recovery passage extending therethrough to permit vapour within the tank which is to be filled by the nozzle to escape from the tank through said vapour recovery passage and including second latch actuator means mounted in said body and adapted to engage said latch to move said latch means from said first position to said second position independently of said first latch actuator means, said second latch actuator means communicating with said vapour recovery passage means and being operative to effect movement of said latch means between said first and second positions in response to an increase in pressure in said vapour recovery passage means above a predetermined pressure.

According to a further embodiment of the present invention there is provided an improvement in an automatic nozzle of the type described which includes the provision of passage means communicating between the vapour recovery passage means and the main chamber in which the latching diaphragm is located such that the ambient pressure in said chamber is equal to the pressure in the vapour recovery passage means whereby releasing of the latch is effected in response to a pressure differential between venturi suction and vapour recovery line pressure.

According to a still further embodiment of the present invention there is provided, in an automatic nozzle having a collapsible vapour recovery shroud extending about its liquid fill tube, a shroud having a sealing ring at the outer end thereof adapted to engage a sealing shoulder projecting from said filling tube, the improvement of; fulcrum support means located inwardly of said shroud and disposed in a first transverse plane and arranged on diametrically opposite sides of said filling tube, said fulcrum support means supporting said sealing ring such that it is free to pivot about said first transverse axis to be self aligning with respect to said first transverse axis and means for resiliently urging said fulcrum means toward said sealing ring.

It is an object of the present invention to provide in an automatic nozzle of a type which incorporates a latch which may be triggered to render the manually engageable opening lever inoperative the improvement of a second latch actuator means for activating said latch means in response to an increase in pressure in the vapour recovery passage means in the nozzle above a predetermined pressure, independently of the first latch actuator means.

it is a further object of the present invention to provide an ambient pressure, in the main diaphragm chamber opposed to the chamber in which suction is induced by the liquid flowing past the venturi cut-off valve which is equal to the pressure in the vapour recovery line.

It is a still further object of the present invention to provide a shroud sealing structure for ensuring accurate sealing of the shroud with respect to a sealing shoulder formed on the filling tube and with respect to the end of the neck of a gasoline storage tank.

PREFERRED EMBODIMENT

Figure 1:
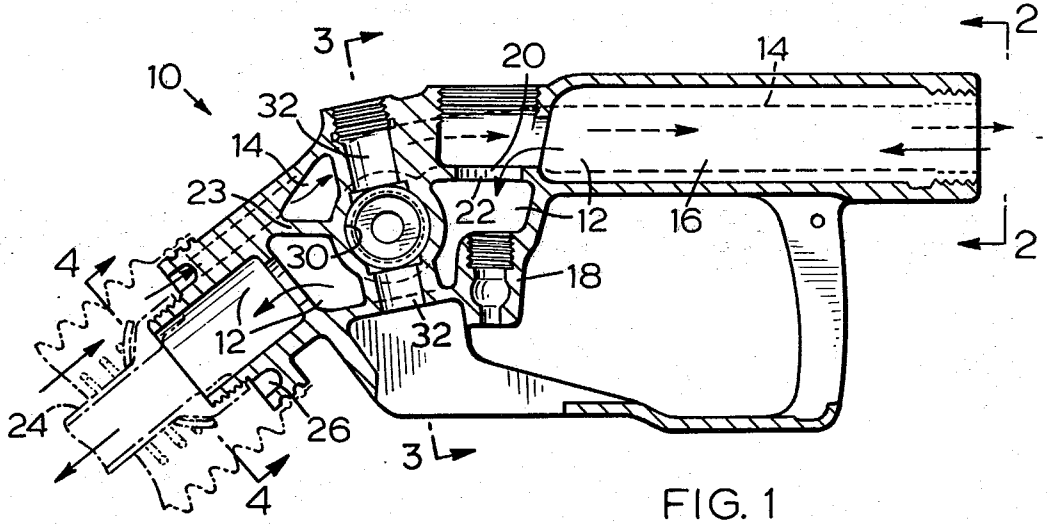
Figure 3:
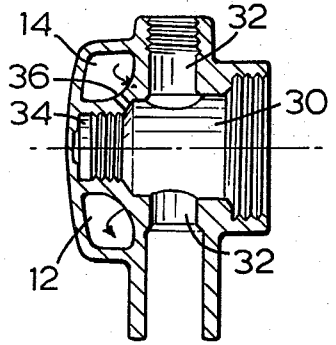
Figure 4:
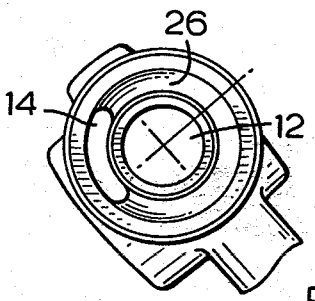
Figure 7:
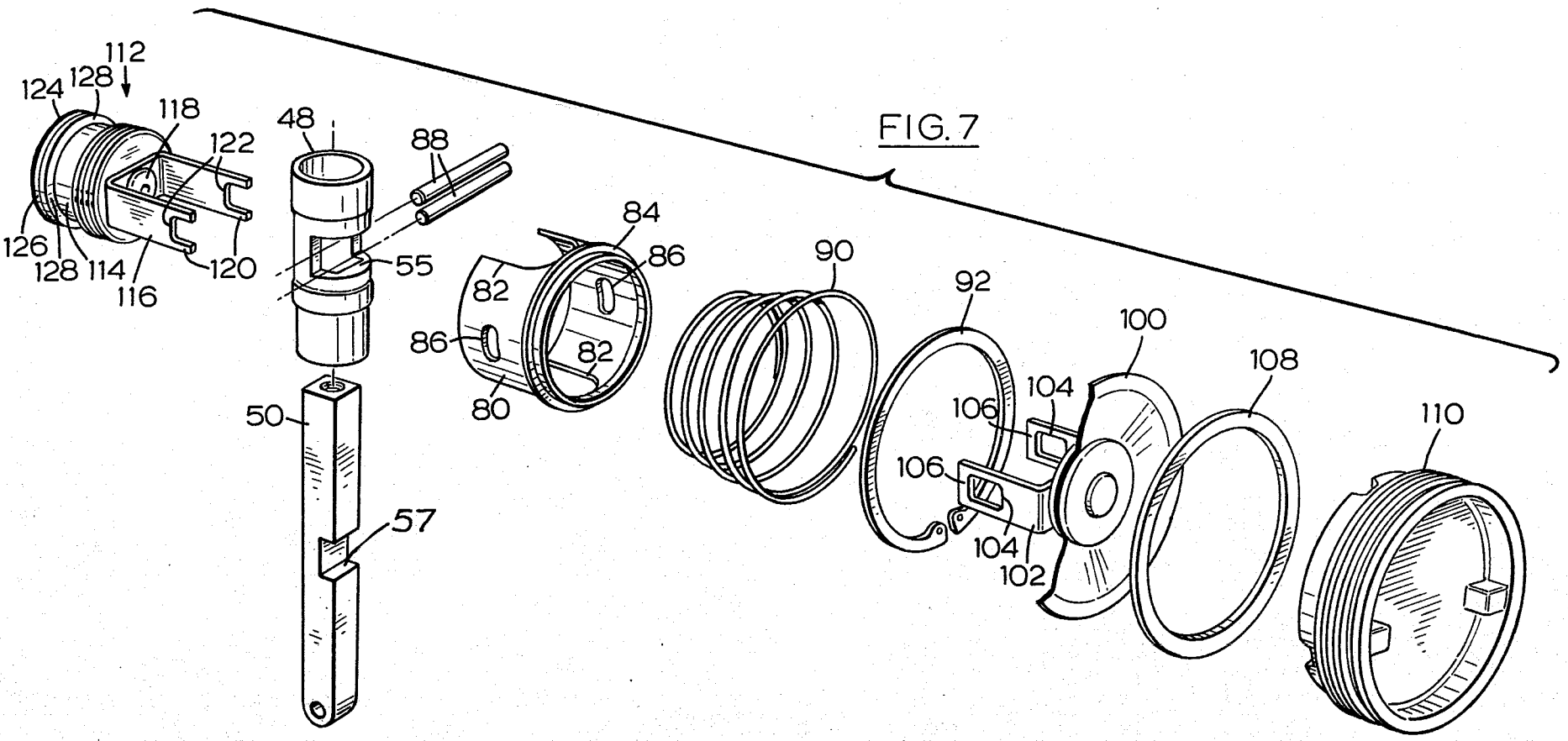
Figure 8:
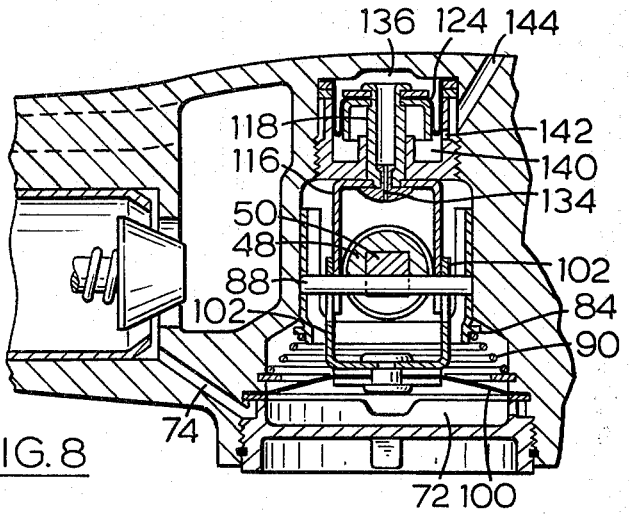
Figure 9:
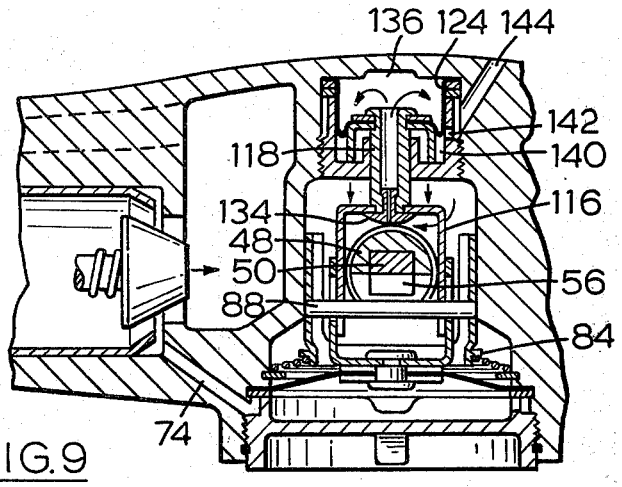
Figure 10:
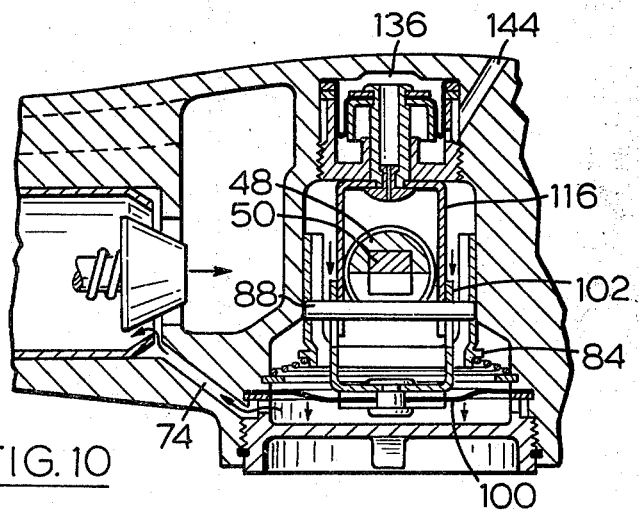

The invention will be more clearly understood after reference to the following detailed specification read in conjunction with the drawings wherein:

FIG. 1 is a sectional side view of the body of the nozzle according to an embodiment of the present invention, FIG. 2 is an end view in the direction of the arrows 2—2 of FIG. 1, FIG. 3 is a sectional view in the direction of the arrows 3—3 in FIG. 1, FIG. 4 is an end view in the direction of the arrows 4—4 in FIG. 1, FIG. 5 is a partially sectioned side view similar to FIG. 1 including the flow control mechanism omitted from FIG. 1 with the shroud sealing mechanism removed for clarity of illustration of the flow control mechanism, FIG. 6 is a sectional view in the direction of the arrows 6—6 of FIG. 5, FIG. 7 is an exploded view of the slide and actuator mechanisms in the section of FIG. 6 of the drawings, FIG. 8 is a sectional plan view of an assembled actuator mechanism in a first position, FIG. 9 is a sectional plan view similar to FIG. 8 illustrating the actuator mechanism in the second position, FIG. 10 is a sectional plan view similar to FIG. 8 illustrating the actuator mechanism in third position, FIG. 11 is a partially sectioned side view illustrating the vapour recovery shroud in a position sealed with respect to the filling tube, FIG. 12 is a partial plan view of the structure of FIG. 11, FIG. 13 is a side view similar to FIG. 11 showing the filling tube located in a tank which is to be filled, and FIG. 14 is a view of the shroud sealing member taken along the line A—A of FIG. 11.

Figure 15:
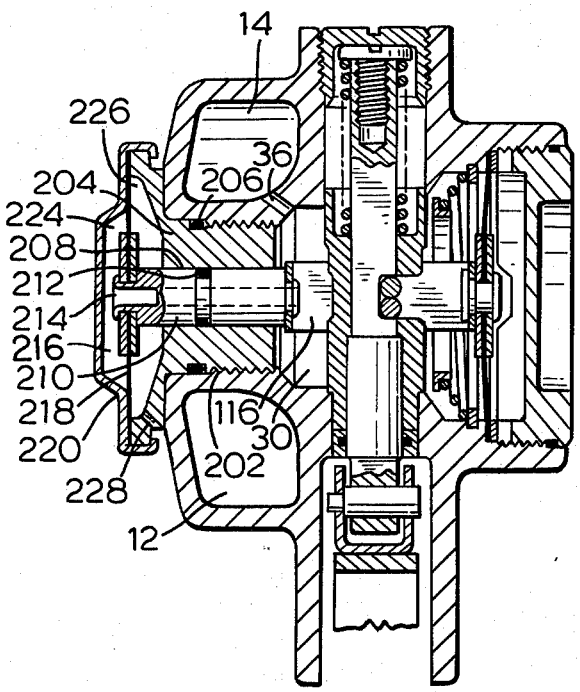

FIG. 15 is a sectional view similar to FIG. 6 of an alternative construction.

The automatic nozzle illustrated in the preferred embodiment of the present invention employs a structure similar to that described above insofar as it relates to the control of the flow of liquid and the mechanism for interrupting the flow of liquid when the level of liquid in the tank which is being filled rises above a predetermined level. The structure of the nozzle of the present invention differs from that of U.S. Pat. No. 3,196,908 in that it includes a structure which serves to automatically close the liquid flow control valve in the event that the pressure in the vapour recovery line which passes through the body of the nozzle rises above a predetermined acceptable value. This value closing tripping action functions independently of the valve closing tripping action provided when the level of liquid in the tank which is being filled rises above the end of the filling tube of the nozzle as described in the aforesaid part of the U.S. patent. A further difference is in that the ambient pressure against which the latching diaphragm operates is equal to the pressure in the vapour recovery line. This results from the fact that a passage is formed in the body of the nozzle which commutes between the vapour recovery passage and the main diaphragm chamber. The structure of the present invention also differs from that of the aforesaid prior patent in that it provides an ambient pressure in the main diaphragm chamber opposed to the suction chamber which is equal to the pressure in the vapour recovery line. In addition the present invention provides a shroud sealing structure which provides accurate sealing of the shroud with respect to the neck of a gasoline storage tank of an automobile or the like.

With reference to FIG. 1 of the drawings the reference numeral 10 refers generally to the body of an automatic nozzle according to the embodiment of the present invention. The body 10 differs from that according to U.S. Pat. No. 3,196,908 in that it includes both a liquid filling passage 12 and a vapour recovery passage 14. in the handle 16 of the body the passages 12 and 14 extend in a spaced parallel relationship and in the head porition 18 of the body, the passage 12 extends downwardly through a valve seat 20 formed in a divider wall 22 and exits from the head into a fill tube 24. The divider wall 22 serves to space the input of the liquid fill passage 12 from the output thereof. The divider wall 22 serves to space the liquid fill passage 12 from the vapour recovery passage 14 within the head portion. The vapour recovery passage 14 opens outwardly from the body through an arcuate opening (FIG. 4) which opens into an annular recess 26 which extends circumferentially about the outward end of the flow passage 12. As shown in FIG. 3 of the drawings an actuator chamber 30 opens inwardly from one side of the head 18 and a slide passage 32 opens through the head at right angles to the chamber 30. A recess 34 is formed at the inner end of the chamber 30 and a passage 36 extends between the vapour recovery passage 14 and a central portion of the chamber 30.

As shown in FIG. 5 of the drawings a valve member 40 having a valve stem 42 is slidably mounted in the head and serves to close the passage 20 formed in the wall 22 so as to interrupt the flow of liquid through the liquid fill passage 12. A coil spring 44 serves to urge the valve stem 42 towards the closed position. The plunger mechanism 46 consists of fixed body member 48 which is mounted in the passage 32 and a slide member 50 which is slidably mounted with respect to fixed body member 48. A coil spring 52 extends between the underside of the head of the screw 54 which is mounted at the upper end of the slide member 50 (FIG. 6) and the upper end of the fixed body portion 48. The upper end of the passage 32 is closed by a threaded plug 56. A manually engageable handle 60 is connected to the lower end of the slide member 50 by means of the pivot pin 62.

When the slide member 50 is retained in the position shown in FIG. 5 the handle 60 is operable to move in the direction of the arrow A to engage the valve stem 42 to move the valve head 40 to an open position to permit the liquid to flow through the liquid flow passage 12.

The slide member 50 is released from the position shown in FIG. 5 in response to the level of liquid in the tank rising above a predetermined point at the lower end of the fill tube 24 by a mechanism which is substantially the same as that previously described with respect to U.S. Pat. No. 3,196,908. This mechanism includes a vacuum vent passage 70 communicating with a vacuum chamber 72 formed in the head 10 by way of vacuum tube 74.

The structure of the latching mechanism is illustrated in FIG. 6 and 7 of the drawings. This mechanism includes a fixed body portion 48 which previously described is located within the passage 32 and which is formed with U-shaped slot 55 opening inwardly from one face thereof. Also as previously described the slide member 50 has a U-shaped slot 57 opening inwardly from one face thereof. A tubular sleeve 80 is slidably mounted within the chamber 30 and has U-shaped openings 82 opening inwardly from one thereof which permit the sleeve 80 to extend beyond the fixed body portion 48. Short elongated slots 86 are formed in the walls of the sleeve 80 to receive the ends of latching rollers 88 to mount the latching rollers 88 within the sleeve 80 for movement therewith into and out of engagement with the U-shaped slots 55, 57. An annular shoulder 84 is formed at one end of the sleeve 80. A coil spring 90 has one end which bears against the shoulder 84 and another end bearing against a circular spring clip 92, which is located in the recess 94 formed in the head of the nozzle, so that the spring 90 urges the sleeve 80 in a direction towards the slide 50 so that the latching rollers 88 are urged inwardly of the slots 55 and 57.

The first actuator mechanism includes the diaphragm member 100 which supports a U-shaped bracket 102. The U-shaped bracket 102 has elongated slots 104 in the oppositely disposed arms thereof. The slots 104 are closed at their outer ends by a transversely extending portion 106. The diaphragm 100 is mounted in the chamber 103 by means of a clamping ring 108 and a closure plug 110 so that the vacuum chamber 72 is formed between the diaphragm 100 and the wall of the closure plug 110. As previously described the diaphragm chamber 72 communicates with the vacuum mechanism so that when the level of liquid in the tank rises above a predetermined level, the vacuum generating device draws a vacuum in the chamber 72 causing the diaphragm 100 to move towards the wall of the closure plug 110, thereby causing the U-shaped bracket 104 to move away from the slide member 50 to move the latching rollers 88 out of engagement with the U-shaped slot 57 in the slide member 50, so that the handle 60 is deactivated thereby permitting the valve member 40 to move to the closed position. This structure is substantially the same as that previously described with respect to U.S. Pat. No. 3,196,908 with the exception that the bracket 102 is formed with elongate passages 104 to permit relative movement between the rollers 88 and the barcket 102 as will be described hereinafter.

The second actuator mechanism is generally indentified by the reference numeral 112 in FIG. 7 and consists of housing 114 which is threadably mounted in the inner chamber 34. A U-shaped bracket 116 is mounted on the end of shaft 118 which is slidable with respect to the housing 114. A U-shaped recess 120 is formed at the outer end of each of the arms of the U-shaped bracket 116. Each of the U-shaped recesses 120 has an inner edge 122 which is adapted to engage the rollers 88 and used to push the rollers 88 out of the slots 55 and 57. A rolling diaphragm 124 (FIG. 6) is mounted at the inner end of the shaft 118 and has its outer peripheral edge clamped between the body of the housing and the clamping washer 126. A spacer washer 128 is located between the clamping washer 126 and the end of the housing 114. The diaphragm 124 is clamped at its inner edge between flat washer 130 and a washer 132 which has a cylindrical extension projecting towards the transverse wall of the housing 114. The inner edge of the washer 132 rests against the wall of the housing 114 to limit the movement of the shaft 118 in a direction towards the latching roller pins 88. The shaft 118 is formed with a passage 134 opening therethrough.

The vapour in the vapour recovery line comunicates with the second diaphragm chamber 136 by way of the passage 36 and the passage 134. The chamber 140 (FIG. 8) which is formed within the second actuator device opens to atmosphere through passage 142 formed in the body 114 and the passage 144 formed in the body of the nozzle.

When the nozzle is not operational the spring 52 draws the slide member 50 upwardly into a position in which the slot 57 is aligned with the slot 55 in the member 48 and the spring 90 forces the latch rollers 88 into the slot 57 to retain the slide member 50 in the position shown in FIG. 6 with the drawings.

The operation of the latching mechanism will be described with reference to FIGS. 8 to 10 of the drawings. As indicated above, when the nozzle is not in use the various springs will act to locate the latching rollers 88 and the slot 57 so that the handle 60 may be manually engaged and moved in the direction of the arrow A to open the valve 40 to permit liquid to flow through the liquid fill line 12. The flow through the liquid fill line causes a displacement of vapour in the tank which is being filled and the vapour is discharged from the tank through the vapour recovery passages 14. As long as the pressure of the vapour recovery passage is below a predetermined minimum filling of the liquid continues. If the pressure in the vapour recovery passage rises above a predetermined minimum generally about 8 to 12 inches of water the pressure increase is transmitted from the vapour recovery passage 14 by way of passages 36 (FIG. 6) and 134 to the chamber 136 and the pressure increases in the chamber 136 and the diaphragm is activated and causes the shaft 118 to move towards the slide member 50. The inner ends 122 of the U-shaped slots 120 in the arms 116 engage the rollers 88 and move them out of the slot 57 thereby releasing the slide member 50. As previously indicated the rollers 88 are mounted in the sleeve member 80 so that the movement of the rollers 88 out of the slot 57 causes compression of the spring 90. It will be noted however, that the first diaphragm member 100 and its associated U-shaped bracket 102 is not affected by the movement of the rollers 88 by reason of the elongated passages 104 in the bracket 102. FIG. 9 of the drawings serves to illustrate the relative position of the various components when the second actuator mechanism moves to a position in which the latching rollers 88 release the slide member 50. When the slide member 50 is released the manually operable handle 60 is rendered inoperative by reason of the fact that the spring 44 over-powers the spring 52 and causes the slide member 50 to move to a position which permits the valve member 40 to be located in the closed position closing the liquid fill line.

FIG. 10 of the drawings illustrates the manner in which the latching rollers 88 are withdrawn from the slot 57 by means of the oscillating diaphragm 100 which as previously described occurs when the venting of the vacuum generating device by way of the vent line 74 is interrupted by the rising level of liquid in the storage tank. Again it will be noted that when the first diaphragm 100 is operational to release the slide member 50 the second actuator mechanism is totally unaffected by the movement of the first actuator mechanism.

It will be apparent from the foregoing description of the first and second actuator means that while one may operate independently of the other there are circumstances under which simultaneous operation of both actuator mechanisms is desirable. In view of the fact that one actuator mechanism operates entirely independently of the other the present structure permits simultaneous operation aboard the actuator mechanisms in the event of a simultaneous interruption of the vacuum to the vacuum vent line and an increase in pressure in the vapour recovery line above the predetermined minimum pressure.

In order to direct the vapour which is to be recovered by way of the vapour recovery passages 14 a shroud 150 (FIG. 11) is mounted by means of retaining rings 152 at the end of the head from which the filling tube 24 projects. The shroud is tubular in form and extends in a spaced parallel relationship with respect to the filling tube 24 to form a chamber 154 outwardly therefrom, the inner end of the shroud 150 is formed with a series of pleats 158 which permit the shroud to extend and contract longitudinally as required. A sealing ring 156 is secured to the outer end of the shroud 150 and has a passage 160 opening therethrough through which the filling tube 24 extends.

An annular ring 170 is mounted on the filling tube 24 and projects radially therefrom. The annular ring 170 provides a sealing ring shoulder 172 which seals against the sealing ring 156 when the shroud 150 is extended. This condition exists when the nozzle is not in use. The sealing ring 156 is maintained in the position engaging the annular ring 170 by means of a spring-loaded fulcrum mechanism generally identified by the reference numeral 174. This mechanism includes a collar 176 which is adapted to extend in a free fitting sliding relationship about the filling tube 24. The collar 176 has a pair of fulcrum arms 178 projecting outwardly therefrom on opposite sides of the filling tube. The fulcrum arms 178 project in a spaced parallel relationship with respect to one another in a plane which extends transversely of the filling tube. An annular convex seat member 180 extends about the tube 24 and rests against the clamping nut 182 which serves to secure the filling tube 24 to the head of the nozzle. The compression spring 184 extends between the seat 180 and the collar 176 and serves to urge the collar 176 in a direction away from the seat 180. The sealing ring 156 is preferably made from a resilient material which is rigidified by a rigid annular metal insert 186 which has a passage opening therethrough aligned with the passage 160 of the sealing ring 156. The rigid annular insert 186 has a pair of circular recesses 188 formed therein to receive the rounded ends of the fulcrum arms 178. As shown in FIG. 14 of the drawings, the recesses 188 are located on a centre line 190, one on either side of the centre line 192. The centre line 194 is the centre line of the external diameter of the resilient sealing ring 156 and the rigidifying plate 186. The centre line 196 is the centre line of the passage 160 and the passage in the rigidifying metal plate 186. The location of the centre line 190 of the recesses or sockets 188 above the centre line 196 of the opening 160 serves to cause the assembly to tilt forwardly to the position shown in FIG. 13 when in use to obtain an effective seal between the sealing ring and the end of the filling tube 162 of the gas tank. When in the position illustrated in FIG. 13 of the drawings, the recovered vapour enters the chamber 154 by way of the gap formed between the annular shoulder 170 and the sealing ring 156 as shown by the arrow B. When the filling tube is removed from the gas tank, the spring 184 serves to cause the sealing ring 156 to return to the position illustrated in FIG. 11 of the drawings wherein the sealing ring 156 engages the sealing surface 172 of the shoulder 170.

An important feature of the present invention is the provision of an ambient pressure, in the main diaphragm chamber which is opposed to the chamber in which suction is induced by the liquid flowing past the venturi cut-off valve, which is equal to the pressure in the vapour recovery line. As previously indicated, the vapour recovery passage 14 communicates with the main diaphragm chamber which is opposed to the suction chamber by means of passage 36, so that the ambient pressure in the main diaphragm chamber is the pressure in the vapour recovery passage 14. It has been found that with the ambient pressure in the main diaphragm chamber corresponding to the pressure of the vapour recovery line the release mechanism for the slide is not as sensitive to the pressure in the gasoline storage tank and, consequently, the mechanism is only released when the flow passage 70 is truly blocked or when there is an increase in pressure in the vapour recovery line above the predetermined limit.

From the foregoing it will be apparent that the present invention provides a simple and effective mechanism whereby the flow of liquid into a liquid storage tank may be interrupted when the pressure in the vapour recovery line increases above a predetermined minimum level. In addition the present invention provides a simple and efficient shroud mechanism which effectively seals the communication between the storage tank which is being filled and the vapour recovery passages formed in the head of a filling nozzle. Furthermore, the nozzle of the present invention provides a means whereby vapour which is transferred to the vapour recovery line of the nozzle does not escape when the pressure in the vapour recovery system exceeds the pressure outwardly of the nozzle as in the case when the nozzle and its associated shroud is disconnected from the tank which has previously been filled.

Various modifications of the present invention will be apparent to those skilled in the art without departing from the scope of the invention. For example, FIG. 15 of the drawings illustrates a modification wherein a second actuator mechanism is modified to employ a flat diaphragm in place of the rolling diaphragm 124. In this embodiment, a passage 202 opens outwardly from the chamber through the wall of the housing. A plug member 204 is sealed within the passage 202 by means of an O-ring 206. The plug 204 has a passage 208 extending therethrough. A pin 210 is mounted to reciprocate within the passage 208 and an O-ring 212 seals the pin 210 with respect to the passage 208. A passage 214 opens longitudinally through the pin 210 to communicate between the chamber 30 and the chamber 216. The inner end of the pin 210 is secured to the U-shaped bracket 116 and the outer end of the pin 210 is secured to a flat flexible diaphragm 218. An end cap 220 extends over the end of the plug 204 and secures the diaphragm 218 in a position dividing the chamber 216 into an outer chamber 224 and an inner chamber 226. The inner chamber 226 has a vent passage 228 opening outwardly therefrom. Again, the second actuator mechanism serves to activate the latching mechanism in response to a pressure variation in the vapour recovery line above a predetermined maximum pressure. The vapour in the vapour recovery line passes to the chamber 30 as previously described by way of the vent passage 36 and thereafter it passes through the passage 214 to the outer chamber 224. An increase in pressure in the outer chamber 224 resulting from an increase of pressure in the vapour recovery line will cause the diaphragm 218 to move inwardly, thereby causing the rod 210 to move inwardly to move the U-shaped bracket 116 which in turn moves the latching pins 88 out of the slot 56 in a manner similar to that illustrated in FIG. 9 of the drawings. The slide 50 is thereby released to deactivate the flow control valve, thereby interrupting the flow of liquid through the nozzle. It has been found that by locating the diaphragm 218 outwardly of a standard nozzle head, it is possible to obtain the required diaphragm area in order to provide the required degree of sensitivity without requiring the use of a rolling diaphragm of the type described in the earlier embodiments.

These and other modifications will be apparent to those skilled in the art.

What I claim as my invention is:

1. In an automatic nozzle having, a main body, a liquid fill tube projecting from the main body, a longitudinally collapsible vapour recovery shroud extending from said main body about said filling tube, said shroud having a sealing ring at the outer end thereof for engaging the filling pipe of a fuel storage tank, the improvement of, a. a collar movably mounted on said liquid filling tube and disposed between said main body and said sealing ring, b. compression spring means mounted on said liquid filling tube between said collar and said main body, said compression spring means urging said collar in a direction away from said main body, c. a pair of arms mounted on said collar on diametrically opposite sides of the collar, said arms being spaced laterally from opposite sides of said liquid filling tube, d. seat means in said sealing ring engaging the outer ends of said arms to permit said sealing ring to pivot about a first axis extending transversely between the outer ends of said arms under the influence of said compression spring means to sealingly engage the end of the filling pipe of a fuel storage tank.

2. An automatic nozzle as claimed in claim 1 wherein said sealing ring comprises, a resilient annular sealing disc having a second axis disposed centrally of its external diameter located above and parallel to said first axis, and a passage opening therethrough to receive the filling tube, said passage having a third axis disposed parallel to said first axis and located directly below said second axis, a rigid annular insert carried by said resilient annular sealing disc and exposed at an inner face of said resilient sealing disc, said rigid annular insert having a passage opening therethrough which is aligned with said passage of said resilient annular sealing disc, said seat means consisting of recess means formed in said exposed rigid annular insert on opposite sides of said passage means.

* * * * *